United States Patent [19]

Shisko

[11] Patent Number: 4,955,169

[45] Date of Patent: Sep. 11, 1990

[54] HARDBOARD SIDING

[75] Inventor: Walter S. Shisko, Corbeil, Canada

[73] Assignee: MacMillan Bloedel Building Materials Limited, Weston, Canada

[21] Appl. No.: 365,777

[22] Filed: Jun. 14, 1989

Related U.S. Application Data

[63] Continuation-in-part of Ser. No. 148,003, Jan. 25, 1988, abandoned, which is a continuation-in-part of Ser. No. 8,257, Jan. 29, 1987, abandoned.

[51] Int. Cl.[5] ..... E04D 1/00

[52] U.S. Cl. ..... 52/536; 52/539; 52/541

[58] Field of Search ..... 52/536, 539, 541, 533, 52/560

[56] References Cited

U.S. PATENT DOCUMENTS

| | | | |
|---|---|---|---|
| 463,649 | 11/1891 | Rollins | 52/541 |
| 494,543 | 4/1893 | Betts | 52/533 |
| 525,442 | 9/1894 | Burrows . | |
| 2,168,217 | 8/1939 | Kirschbraum | 52/560 |
| 2,231,007 | 2/1944 | Vane . | |
| 2,279,382 | 4/1942 | Swenson . | |
| 2,400,357 | 5/1946 | Krajci | 52/541 |
| 2,595,821 | 5/1952 | Turman | 52/539 |
| 2,680,267 | 6/1954 | Remstein | 52/541 |
| 3,003,205 | 10/1961 | Frashour | 52/560 |
| 4,015,392 | 4/1977 | Eaton | 52/541 |
| 4,188,762 | 2/1980 | Tellman | 52/541 |
| 4,261,152 | 4/1981 | Tellman | 52/541 |
| 4,292,776 | 10/1981 | MacDonald | 52/394 |
| 4,468,909 | 9/1984 | Eaton | 52/541 |

FOREIGN PATENT DOCUMENTS

| | | | |
|---|---|---|---|
| 500218 | 2/1954 | Canada | 52/541 |

*Primary Examiner*—John E. Murtagh

*Attorney, Agent, or Firm*—Fetherstonhaugh & Co.

[57] ABSTRACT

A siding panel formed from a body of hardboard material is formed with a locking tongue at or adjacent its upper edge and a locking seat at its lower edge. The locking tongue of one panel is arranged to be seated in the locking seat of another panel when adjacent panels are arranged with their marginal edge portions overlapping one another in use. The locking seat is in the form of a notch which is formed in the back face of the body of the panel. The notch extends upwardly from the lower edge and underlies the lower marginal edge portion of the panel.

16 Claims, 7 Drawing Sheets

HARDBOARD SIDING

CROSS REFERENCE TO RELATED APPLICATIONS

This application is a continuation-in part of U.S. Pat. application 07/148,003, filed Jan. 25, 1988, now abandoned which in turn is a continuation-in-part of application 07/008,257 filed Jan. 29, 1987, now abandoned.

BACKGROUND OF THE INVENTION

1. FIELD OF THE INVENTION

This invention relates to siding. In particular, this invention relates to hardboard siding in which improved interlocking tongues and notches are provided for retaining adjacent panels in an overlapping relationship.

In each embodiment of the invention, the interlocking joint configuration of the panels insures that the nails which are utilized to secure the panels to an underlying material are covered by an overlapping marginal lower edge portion of an adjacent panel so that the nails are not exposed to the elements while simultaneously locking the lower marginal edge of the adjacent panel. The joint configurations also minimize the amount or percentage of panel surface which must be used to form the overlaying joints and provide for true horizontal alignment of each panel during installation.

2. History of the Related Art

Hardboard is a popular material for use in the manufacture of siding panels in the construction industry. Hardboard has been used to form siding panels for more than 20 years.

For the purposes of securing the siding to a building, it is customary to nail through an upper marginal edge portion of the lowest panel and then to apply the next panel so that it's lower marginal edge overlies the upper marginal edge of the previous panel and obscures the nails which have been driven through the previous nailed upper marginal edge. Thus, when a wall is completed, the only nails which are visible are those located along the upper marginal edge of the uppermost panel. It is customary to apply a cap or flashing in order to obscure these nails and to seal the upper end of the wall.

The problem with prior practices is that the lower marginal edge portion of each panel is free of attachment and consequently, the panels can lift under severe weather conditions or as a result of distortion of the panel resulting from severe climatic conditions or aging. The lifting problems can be easily overcome by merely nailing the lower marginal edge portions. However, if a nail is driven through the lower marginal edge portion, it is visible and is exposed to the elements. In practice in the industry, manufacturers have offered only a limited warranty with respect to their products when they are secured in position by exposed nails.

In order to prevent lifting of the lower marginal edge portion without the use of nails, the industry adopted the practice of inserting a plastic spline into the back face of each panel adjacent the lower edge thereof and providing a complementary locking tongue along the upper edge. This spline and tongue arrangement have been used in the industry for at least 15 years. In order to insert the spline, it is necessary to cut a deep groove in the back face of the panel and then it is necessary to drive an edge of the spline into the groove. This is a process which adds a substantial amount to the cost of manufacturing hardboard siding.

Despite the fact that the use of a spline in order to form a seat has been known to add a significant amount to the cost of producing hardboard siding, the industry has continued to use this spline construction for more than 15 years. In addition, despite the fact that it has been known to shape the upper edge of a hardboard siding panel in order to provide a tongue which can be inserted into the notch formed by the spline, no effort has been made to form a notch or seat capable of accommodating the locking tongue by forming the lower edge of hardboard panels to provide the seat.

In the present invention a locking seat is formed in the body of the siding panel which will adequately seat a locking tongue of an adjacent panel without requiring a separate spline.

Despite the fact that hardboard siding has a number of advantages over natural wood and in particular is not as prone to distortion when subjected to weathering, it is generally accepted care must be taken when shaping and forming hardboard to avoid reducing the thickness of the hardboard to an extent which will cause an edge of the board to break off.

When first considering replacing the seat formed between the spline and the back face of the panel with a seat formed in the body of the panel, knowledge of the accepted practices with respect to the machining of hardboard materials suggested that if a notch were made in the panel to a depth sufficient to provide a seat which would effectively retain a complementary tongue, it would weaken the lower marginal edge to such an extent as to make it fragile and not be capable of withstanding the rugged handling to which siding panels are subjected during shipping and installation. In addition, one of the essential characteristics of siding is that an adequate shadow line must be provided in order to create the desired esthetic finish associated with decorative siding. Therefore, if the thickness of the lower marginal edge portion were reduced, it was believed that the shadow which would be cast by the lower marginal edge portion would be reduced and this would adversely effect the esthetics of the finished product after installation. Surprisingly, it has been found that even if the width of the lower edge of the panel is reduced by 40% a perfectly satisfactory shadow line can be obtained.

Although a V-shaped notch is shown in the fibre insulation board units disclosed in U.S. Pat. No. 2,400,357, the characteristics of fibre insulation board are such that it would not have been obvious to those in the handboard siding industry that such a notch could be formed in an edge of a hardboard siding panel because of the reasons discussed above. The characteristics of hardboard are so dramatically different from those of fibreboard that the two materials are not considered as being interchangeable in the industry. A similar V-shaped notch is shown in the siding material disclosed in U.S. Pat. No. 2,231,007. Again, however, the siding material of the patent is a substantially thick material including an insulated base portion such as wallboard or layers of asphalt or cementitious compositions and a covering portion.

It would not be practical to make a siding panel from hardboard using a moulding process because such a process would be extremely expensive and moulding processes using hardboard generally involve the manufacture of hardboard panels in the conventional manner and subjecting the localized areas of the hardboard to additional compression in order to shape or contour the surface of the panel. It would not, however, be possible to compress a preformed hardboard panel to more than 10% of its preformed thickness and it would certainly be impossible to compress the panel by 40%. It would not therefore be practical to make a hardboard panel shaped to the configurations of the present invention using a moulding process applied to the hardboard.

A further problem encountered in various prior art siding materials is that the amount of material utilized to form the joint between adjacent panels is excessive thereby increasing the cost of the initial product. In U.S. Pat. No. 4,015,392 a siding system is disclosed which incorporates panels which have tongue and groove engaging portions which are spaced inwardly with respect to the upper end portion of the siding member. The nailing with regard to such panels is made in two spaced positions along the elongated upper end portion of each panel with the nails being covered by a portion of the overlying panel which is spaced remotely from the lower marginal edge of the overlapping panel. With this type of structure, approximately 10 to 20% of the effective width of each panel is consumed in providing the nailing surface which is spaced above each of the joints. This increases the effective cost of the material by the same 10 to 20%.

It has also been determined that there are difficulties inherit with installing hardboard siding incorporating tongue and groove structures in obtaining true horizontal alignment of each panel along the side of a given structure. In addition, other problems have been encountered due to the chemical treatment of the face of hardboard siding causing the siding to naturally assume a slight concave curvature when viewed from the front of each panel as the panel members are chemically treated. This places each of the panels in a somewhat curved stressed condition which can lead to fastener loosening over a period of time.

In additional example of a type of prior art siding material which incorporates simulated panels in a single panel structure is disclosed in U.S. Pat. No. 4,261,152.

SUMMARY OF THE INVENTION

It is an object of the present invention to machine the upper and lower marginal edge portions of a siding panel to provide a locking tongue along the upper edge and a locking notch along the lower edge, the tongue and notch being arranged to interlock with corresponding tongues and notches of adjacent panels so as to secure the lower marginal edge of one panel with respect to the upper marginal edge of an adjacent panel without nailing of one to the other.

According to one aspect of the present invention, there is provided in a siding panel a unitary body of hardboard material having a front face, a back face, an upper edge and a lower edge, and upper and lower marginal edge portions, extending inwardly from the upper and lower edges respectively. A V-shaped locking tongue is provided at the upper edge proximal the front face and a locking seat in the form of a notch is formed in the back face of the body and extends upwardly from the lower edge to underly the lower marginal edge portion. The locking tongue is formes by bevelling the upper marginal portion of the panel downwardly and rearwardly from adjacent the front face to the back face so as to form a line of contact on the back face which will engage the underlying support surface when the panel is attached thereto in such a manner that the line of contact is adjacent the lower edge of the overlapping panel when installed. The body has a generally uniform thickness between the upper and lower marginal edge portions which is in the range of about 0.375 to 0.5 inches. The notch has a depth measured from the back face which is no greater than that which reduces the thickness of the lower marginal edge portion to about 0.1875 inches such that when the locking tongue of one panel is seated in the locking seat of another panel when adjacent panels are arranged with their marginal edge portions overlapping one another on a support surface, the greater thickness of the upper marginal edge will serve to space a substantial portion of the back face of the other panel from the support surface to create a drying air gap therebetween.

According to a preferred embodiment of the present invention a siding panel for selective attachment to an underlying support surface is disclosed which incorporates a unitary body of hardboard material having a front face, a back face, an upper edge and a lower edge, and an upper and lower marginal edge portions extending inwardly of the upper and lower edges, respectively. The front face includes at least one elongated tapered groove therein which extends parallel with said upper and lower edges so as to simulate a joint between overlapping adjacent panels. The upper marginal edge portion tapers inwardly from the outer surface toward the upper edge of the panel. The back face is bevelled adjacent the upper edge to provide a generally V-shaped locking tongue with the bevelled upper marginal edge portion extending downwardly and rearwardly from the upper edge at a first acute angle. A locking seat in the form of an elongated generally V-shaped notch is formed in the back face of the panel and extends upwardly from the lower edge so as to underlay the lower marginal edge portion. The notch includes a base portion from which the notch extends outwardly at a second acute angle which is greater than the first acute angle of the locking tongue. The panel includes a predominant thickness dimension between the front and rear faces with the lower marginal edge portion and the locking tongue portion of overlapping panels having a combined thickness dimension when the locking tongue of one panel is seated within the locking seat of an adjacent panel which is substantially equal to the predominent thickness of the panel so that the front and rear faces of assembled panels are generally co-planar when installed to a support surface.

According to yet a further feature of the present invention, the base portion of each of the locking seats may be flattened with the upper edge portion of each panel also being correspondingly flattened.

Yet a further embodiment of the present invention, one or more elongated slots or channels may be provided along the back face of each panel so as to provide stress relief for allowing the panel to assume a co-planar configuration when being fastened or secured to a support surface. In addition, the elongated channels may be utilized to provide for ventilation between the back face of each panel and the underlying support surface.

BRIEF DESCRIPTION OF THE DRAWINGS

The invention will be more clearly understood after reference to the following detailed specification read in conjunction with the drawings wherein.

DESCRIPTION OF THE PREFERRED EMBODIMENT

Figure 1:
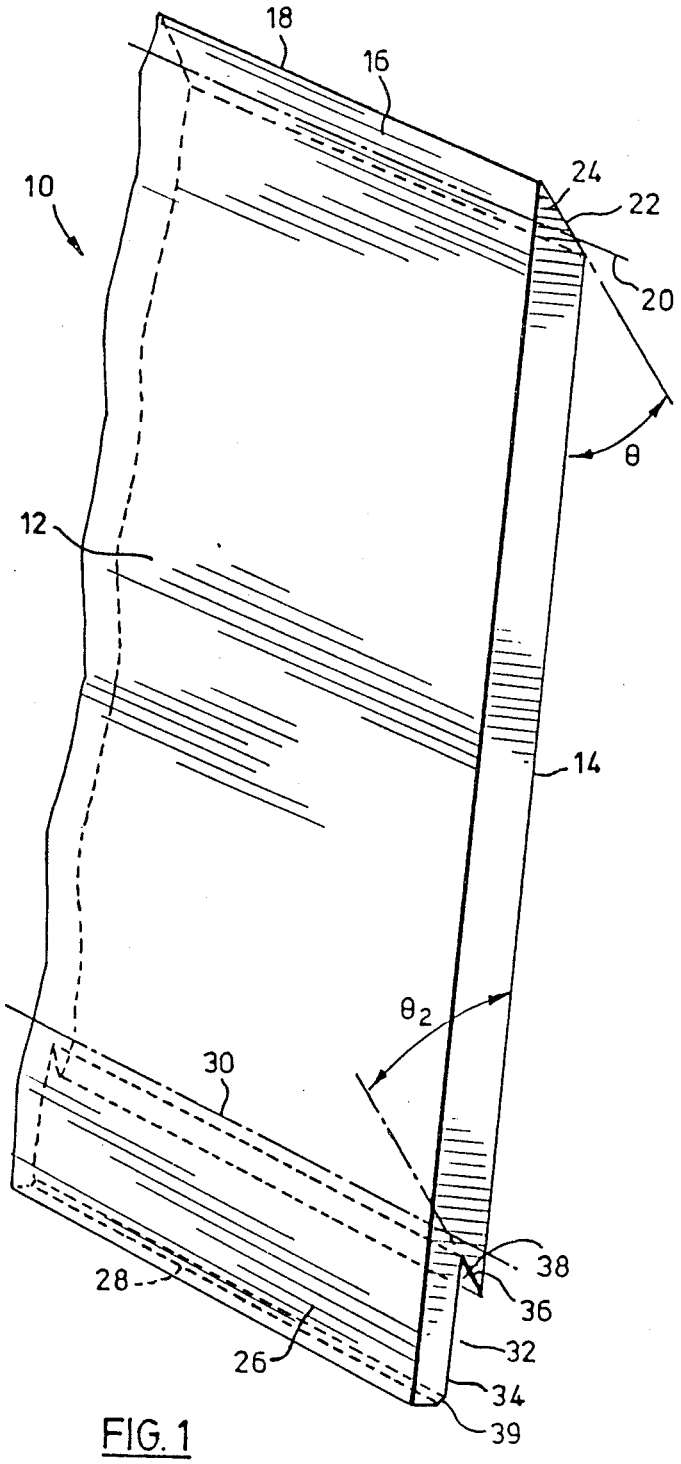
FIG. 1 is a pictorial end view of a siding panel constructed in accordance with an embodiment of the present invention.

With reference to FIG. 1 of the drawings, the reference numeral 10 refers generally to a siding panel constructed in accordance with an embodiment of the present invention. The siding panel 10 is formed from hardboard which is a material which is well known and has been used for the purposes of producing siding for many years. Hardboard is a cellulose wood fibre product. The hardboard which is used to produce the hardboard siding panels of the present invention is produced in a conventional hardboard manufacturing system which commonly produces panels measuring slightly over '×4' by 7/16" in thickness. These panels are not formed in a "moulding" operation. These standard panels are then cut by a saw in order to form rectangular siding panels measuring between 8" and 12" in width and 16' in length. These panels are commonly referred to as being smooth-one-side panels in which the front face is the smooth side. The siding panel 10 has a front face 12 and a back face 14. The front face 12 may have any one of a number of different decorative finishes applied thereto. The backface 14 is a flat face. The thickness of the panel between the front face and the back face 14 may be any standard thickness from which hardboard siding is conventionally produced. The thickness is generally ½' but may be as little as ⅜' but should be more than ¼'. The panel 10 has an upper marginal edge portion 16 which extends from the upper edge 18 to the line 20.

The upper edge 18 is cut by means of a rotary cutter blade to form an inclined face 22 which extends downwardly and rearwardly from adjacent the front face 12 toward the back face 14. The inclined face 22 is inclined at an angle with respect to the front and back faces 12 and 14. The angle is less than 90° and preferably less than 45° while being preferably more than 20°. An angle of 45° was originally believed to provide a good wedging angle without unduly weakening the upper edge 18. However, through actual use it has been determined that angles of between approximately 30–35 and preferable 32 to 33 provide a better wedging angle. The portion of the upper edge which is located between the front face 14 and the inclined face 22 provides a wedge-shaped locking tongue 24 which extends along the full length of the panel 10. The inclined face 22 of the locking tongue meets the back face 14 along a distinct edge 23 which will form a line contact with the underlying support surface 40 (FIG. 2) in use.

Figure 2:
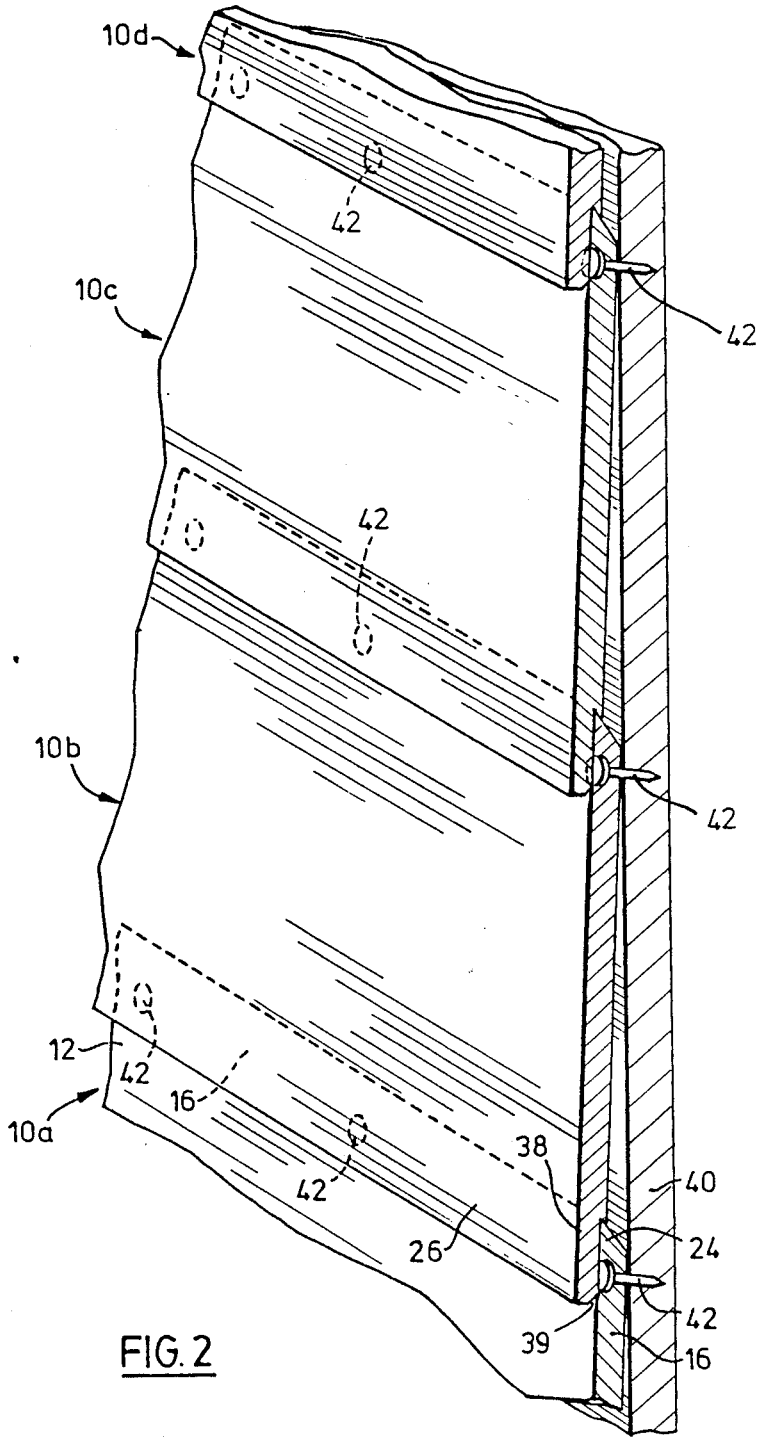
FIG. 2 is a sectional side view showing a number of the siding panels of FIG. 1 mounted on the wall of a support structure.

The panel 10 also has a lower marginal edge portion 26 which extends from the lower edge 28 to a line 30. A locking seat generally identified by the reference numeral 32 is formed in the back face 14 and extends along the lower marginal edge portion 26. The locking seat is cut in the lower marginal edge portion in a machining operation which is carried out by means of a rotary cutter blade or a milling cutter. The locking seat has a first face 34 which extends upwardly from the lower edge 28 in a plane which is parallel to the front face 12. The seat 32 also has a second face 36 which is inclined at an angle $O_2$ with respect to the back face 14. The first face 34 and the second face 36 cooperate with one another to form a V-shaped notch 38 the depth of which from the back face 14 to the first face 34 is less than the maximum thickness of the wedge-shaped locking tongue 24 with the result that when the panels are mounted as shown in FIG. 2, all of the back face 14 of each panel, with the exception of a short portion in the immediate proximity to the edge 23 will be spaced from the underlying support surface 40 to form an air space 41 therebetween. The angles 0 (the accute angle of the locking tongue) and $O_2$ were originally preferably thought to be equal to one another so that the wedge-shaped tongue 24 of one panel will mate with the V-shaped notch 38 of another panel in a close-fitting relationship. However, it has been determined that in order to provide for a completely seated joint structure and to permit accurate alignment of panels along a horizontal line that the angle O must be slightly less than angle $O_2$. Preferably, the angle of the locking seat is between 35° to 40° and more specifically 37° to 38° with the angle of the locking tongue being approximately 5° to 7° less for material which is 7/16' thick and between 5°–10° less for material which is ½'. The respective differences is the angle of the locking seat and locking tongue permit optimum seating while allowing for accurate end to end alignment between adjacent panels. A relief 39 is formed along the lower edge of the first face 34 to prevent "wicking" in use. In addition, the machined surfaces 34, 36 and 22 may be sealed with a coating of wax or the like to reduce moisture absorption.

As shown in FIG. 2 of the drawings, a first panel **10*a* is aligned with respect to an underlying support surface 40 and a plurality of nails are driven through the upper marginal edge portion 16 at longitudinally spaced intervals along the length thereof. When the first panel 10*a* has been secured, the next panel 10*b* can be positioned very easily by aligning the notch 38 with the tongue 24** and inserting one within the other until the panel 10b rests upon the panel 10a with the tongue 24 fitting in a close fitting relationship within the notch 38. It will be noted that the lower marginal edge portion 26 of the panel 10b will overlie the upper marginal edge portion 16 of the panel 10a and will serve to obscure the nails 10. This process is repeated with the panels 10c and 10d until the area of the support surface which is to be covered with siding is completely covered.

From the foregoing, it will be apparent that the present invention provides a simple form of interlocking tongue and groove connection between adjacent upper and lower edges of siding panels. Surprisingly, it has been found that even with siding panels which have a thickness of 7/16" and in which the depth of the seat from the back face 14 to the first face 34 is in the range of ⅛" to ¼", the thickness of the panel along the lower edge 28 is still sufficient to provide a clearly visible shadow line.

The siding panels 10 may be of any standard width generally between 8" and 12" and may be of any standard length which is generally about 16'.

Figure 3:
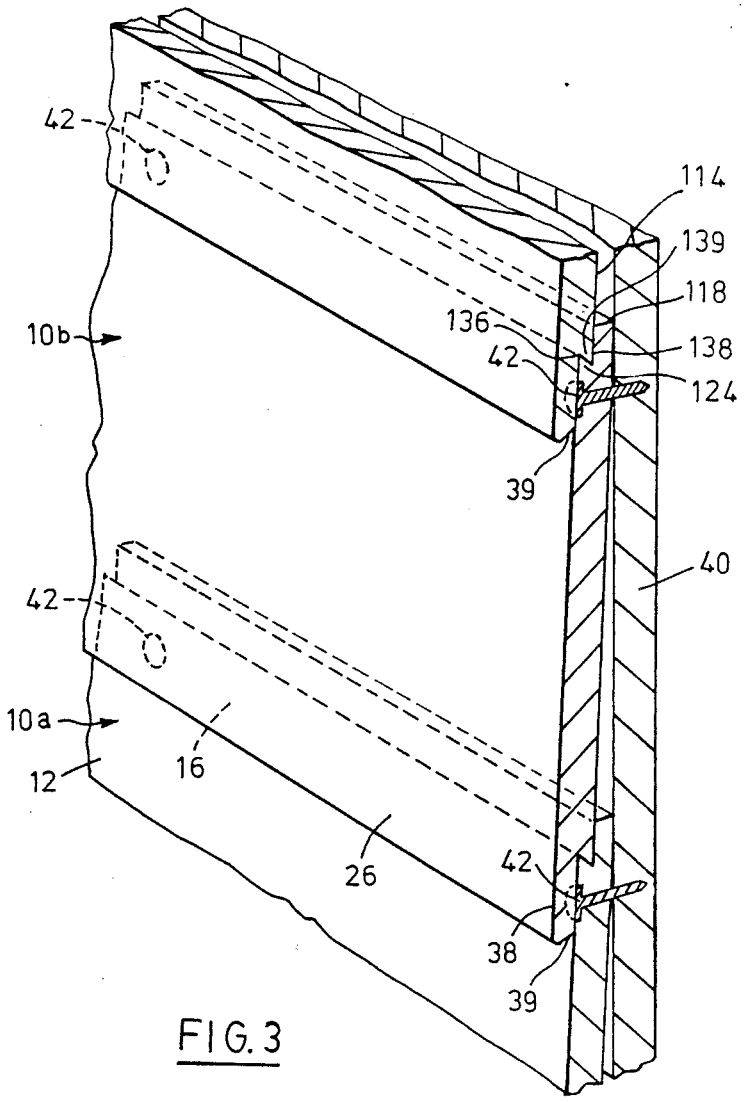
FIG. 3 is a sectional side view of a siding installation illustrating a further embodiment of the present invention.
Figure 4:
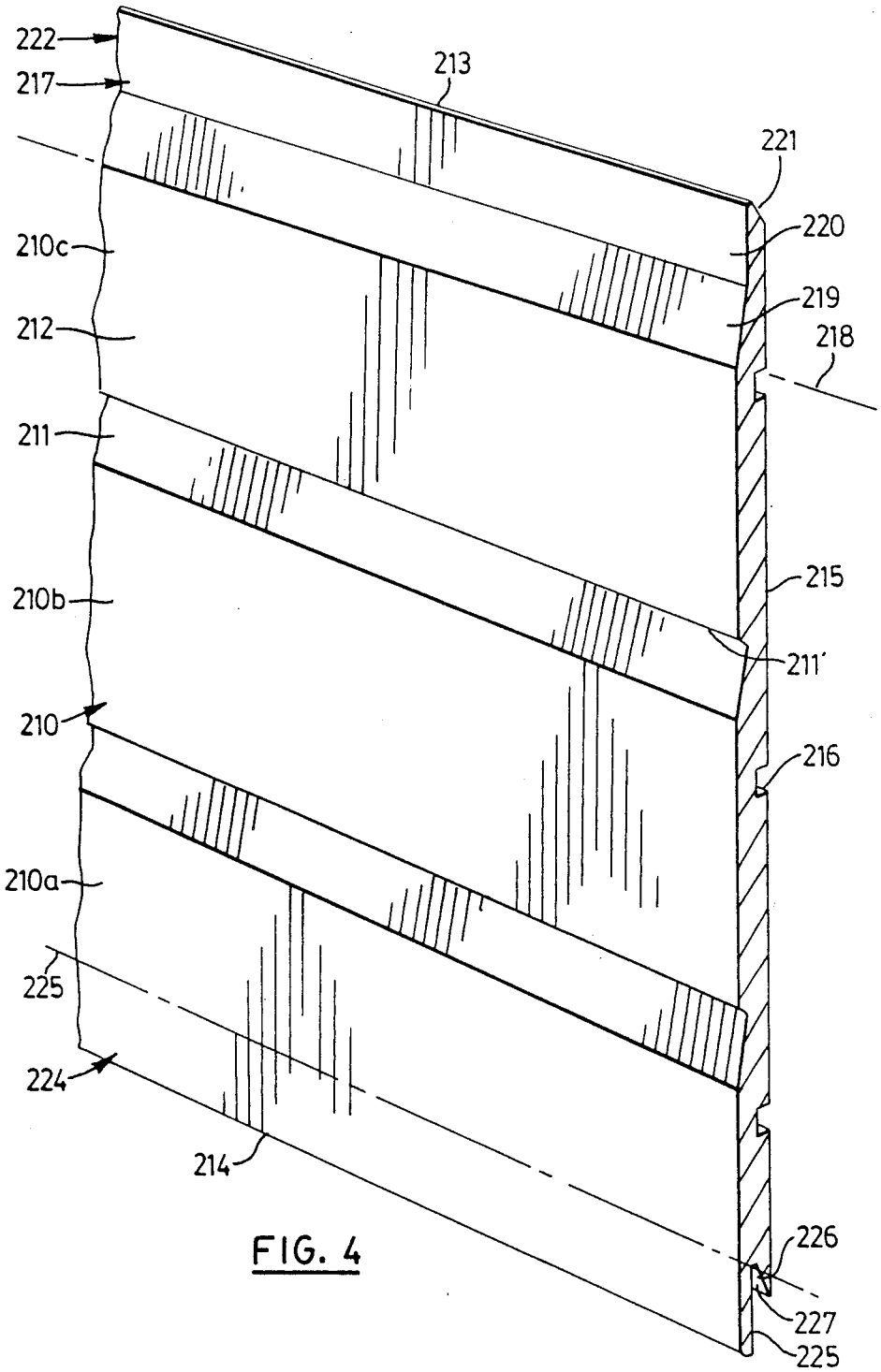
FIG. 4 is a pictorial end view of a siding panel constructed in accordance with a preferred embodiment of the present invention wherein the panel is simulative of a number of individual or single panels such as shown in FIG. 1.
Figure 5:
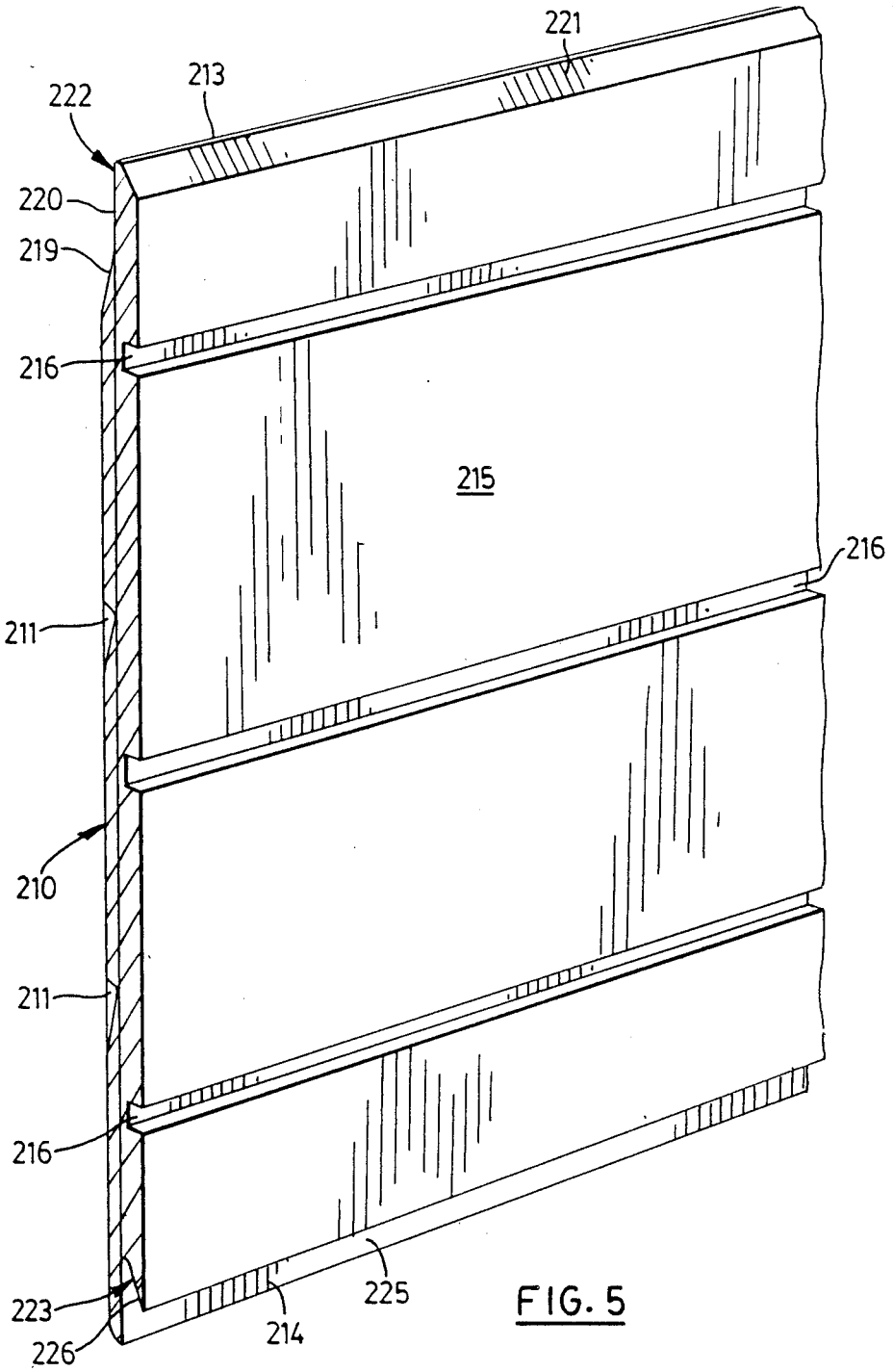
FIG. 5 is a pictorial end view taken from the rear of the panel of FIG. 4 showing the elongated stress relieving and air circulation channels of the embodiment of FIG. 4.

Various modifications will be apparent to those skilled in the art. A further modification is illustrated in FIG. 3 of the drawings wherein it will be seen that the locking tongue 124 is spaced downwardly from the upper edge 118 and forms a V-shaped notch 138 which serves to mate with the V-shaped tongue 139 which is formed between the back face 114 and the second face 136. This arrangement provides two mating tongue and notch elements at each joint. This structure is not preferred, however, due to the waste in material caused by the upper edge 118 extending away from the joint structure. Preferably, the line of contact between the panel and the support surface should be as shown in FIG. 1.

With specific reference to FIGS. 4–9, a preferred embodiment of the present invention is disclosed in greater detail. In this embodiment, the hardboard panels 210 are wider than the panels shown in the embodiments of FIGS. 1–3 and are designed to simulate a plurality of smaller panels by providing one or more tapered grooves 211 which extend along the front face 212 of each panel so as to be substantially parallel with the upper and lower edges 213 and 214 of the panel, respectively. The width of the panel shown in the drawings figures is approximately 12 inches, however, this width may be increased or decreased without changing from the inventive characteristics of this embodiment of the invention. Further, the number of simulated panel portions as indicated at 210a, 210b and 210c may be varied depending upon the width of simulated panels and the width of the panel itself.

The panels 210 include a generally coplanar back face 215 along which are provided one or more elongated channels 216 for purposes of which will be described in greater detail hereinafter.

Each panel further includes an upper marginal end portion 217 The upper marginal end portion extends from the line 218 to the upper edge 213 of the panel and includes an outer tapered surface portion 219 which extends upwardly and inwardly relative to the front face 212 toward the upper edge 213 and which terminates at a level portion 220 that extends upwardly to the upper edge 213 so as to be generally parallel with respect to the rear surface 215 and predominent front face surface 212. The upper portion of the rear surface adjacent the edge 213 is bevelled at 221 so as to taper from the upper edge 213 downwardly and outwardly to the rear surface 215. The bevelled portion 221 and the portion 220 of the upper proximal end of the panel form a locking tongue generally designated at 222 which is selectively engageable with a locking seat 223 formed in the lower marginal end portion 224 of an adjacent panel. The lower marginal end portion being defined between the line shown at 225 and the lower edge 214 of each panel.

The locking seat 223 is formed as a V-shaped notch which is designed to cooperatively receive the V-shaped locking tongue 222 In this respect, the locking seat is formed by providing a notch having a first leg portion 225 which extends generally parallel to the front face so as to underly the lower marginal end of the panel. A second leg portion of the notch is formed by an outwardly and downwardly tappering wall 226 which terminates in remotely spaced relationship with respect to the lower edge 214 of the panel. The length of the wall 226 is substantially equal to the bevelled portion 221 of the locking tongue so that when the locking tongue is seated within the locking seat 223 of an adjacent panel the rear surfaces of each panel would be substantially flush with one another.

Figure 9:
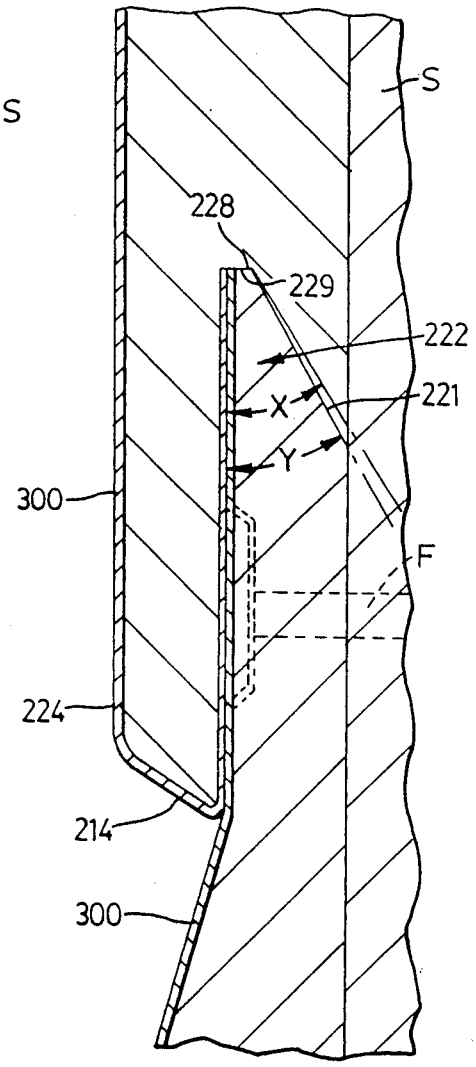
FIG. 9 is an enlarged cross sectional view showing the interlocking tongue and grooves of the present invention and showing that the locking seat of the panels is of an acute angle which is greater than the angle of the locking tongue of the siding panels.

With particular reference to FIG. 9 of the drawings, the locking tongue is preferably formed so that the bevelled portion 221 extends at a first acute angle "Y" which is slightly less than the acute angle formed by the wall portions 225 and 226 of the locking seat 223 as shown at "X". It has been determined that the angle of the locking seat should be between 35° and 40° with 37° to 38° being preferred and that the locking tongue have an angle which is approximately 5° to 7° less than the locking seat for material which is approximately 7/16" in thickness and between 5° to 10° less for material which is ½" in thickness. The difference between the angles of the locking seat and locking tongue of the panels is important in order to allow for optimum seating between adjacent overlapping panels and to allow for proper horizontal alignment of panels extending in end-to-end relationship so that the joints between the panels are continuous and even. To further enhance the interlocking of the panels and to provide for properly aligned joints and simulated joints such as those shown at 211, the upper edge of each panel should be blunted or formed with a flat surface which need not exceed approximately 1/32". This surface is shown in enlargement in FIG. 9 at 228. Likewise, the base portion 229 of the locking seat should be similarly flattened so as to receive and abut the flattened end portion of the locking tongue of a mating panel. The base of the notch should have approximately the same dimensions as the flattened end portion of the locking tongue.

With specific reference to FIGS. 5–8 of the drawings, the panels are installed to a support surface S by driving nails or suitable fasteners through the uppermost portion 220 of the upper marginal ends of the panels so as to be spaced slightly below the bevelled wall portion 221 of the locking tongue 217. Thereafter, an overlapping panel such as shown at 210' is placed so that the locking seat thereof engages with the locking tongue of the underlaying panel 210. When installed, the rear surface 215 of the panel will be generally flush with the support surface S. This is unlike the embodiment of FIGS. 1–3 wherein the panels abut the rear surface along a line of contact so as to create air spaces between the panels and the support surface.

Figure 6:
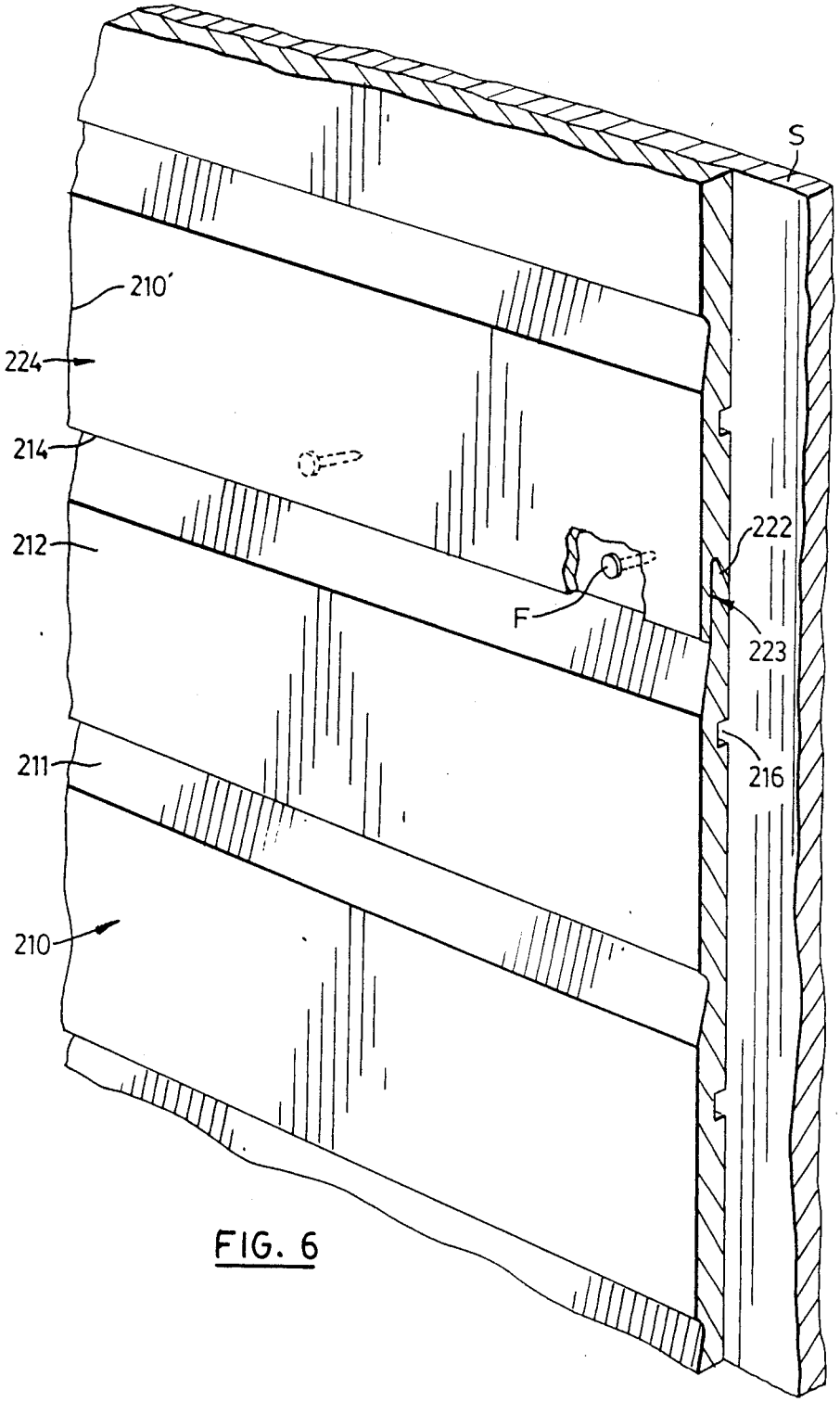
FIG. 6 is a sectional side view showing two of the siding panels of FIG. 4 mounted in assembled relationship on an underlying support surface having portions broken away to show the nails utilized for fastening the panels to the support surface.

When the panels are assembled in overlapping relationship as shown in FIG. 6, the lower marginal end portion of one panel will extend over the uppermost portion 220 of the upper marginal end portion with the lower edge of the panel 214 being aligned with the intersection between the tappered portion 219 and the uppermost portion 220 of the upper marginal end portion thereby creating a joint which is of the same physical dimensions as the simulated joints shown at 211. In this respect, each of the simulated joints has the same taper as the taper of the tapered portion 219 of the upper marginal end portion and further include a beaded wall portion as shown at 211' which is of a depth and contour which simulates the overlap and configuration of the lower edge 214 of one panel with the upper marginal end portion of an adjacent panel. To this end, and as shown in FIG. 9, the lower edge 214 of each panel may be slightly rounded or tapered.

Figure 7:
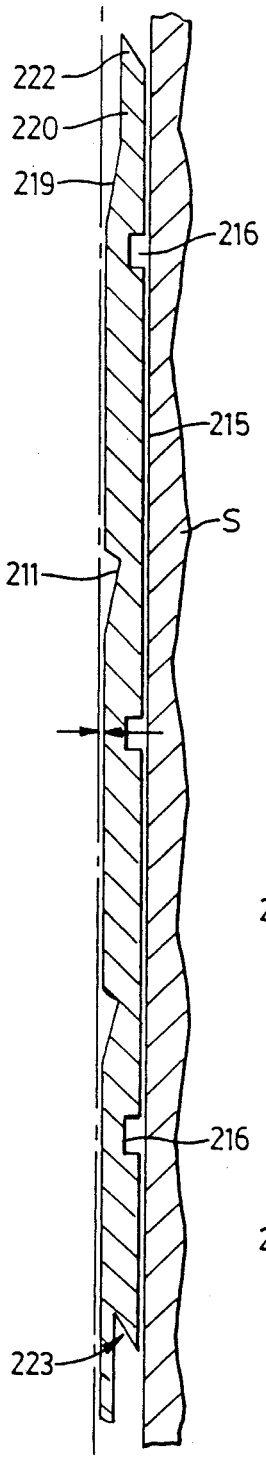
FIG. 7 is a cross sectional view of the siding panels of FIG. 6 showing the slight concave bow in each panel prior to the panel being fastened to the underlying support surface.

A problem inherent with the use of wider hardboard materials is that when the outer surface 212 thereof is treated for waterproofing by the application of phenolic resins, the materials will have a tendancy to assume a slight bow as shown in FIGS. 7 wherein the panels are slightly concaved when viewed from the front face. Therefore, when the panels are applied to a support surface the upper and lower marginal edge portions will tend to be elevated slightly with respect to the support surface. In order to relieve stress to insure that nails and other fasteners are not adversely affected by the pre-stressed condition of the hardboard caused by the chemical treatment of its outer face, one or more elongated channels 216 are provided along the length of the panels in the back face portions 215 thereof The depth of the channels should preferably not exceed approximately ¼ to ⅓ of the maximum thickness of the material which is also the predominent width of the material. As discussed hereinbefore, generally the materials are between 7/16" to ½41 in thickness.

Figure 8:
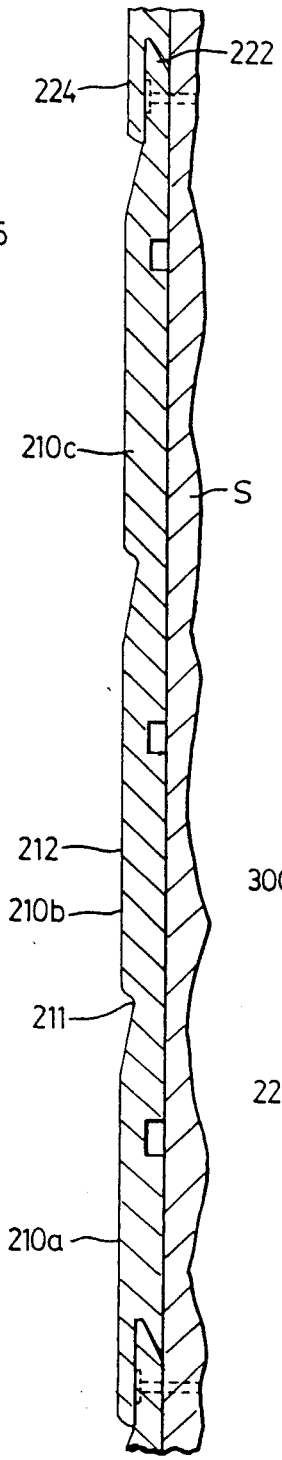
FIG. 8 is a cross sectional view similar to FIG. 7 showing how the panel is flush with the support surface with the elongated channels providing stress relief as the panel is straightened from the curved configuration shown in FIG. 7.

With respect to FIG. 8, each of the elongated channels extends generally parallel with respect to the upper and lower edges of the panel. In addition, each channel includes a pair of spaced wall portions which will have a tendancy to close slightly with respect to one another as the panel is fastened such as by nailing to the support surface. In this manner, the channels will have the effect of relieving stress on the fastening elements which would otherwise be caused by the pre-stressed condition of the front face of the panels. In addition to the foregoing, the channels will also provide for some ventilation between the panels and the support surface in those instances where ventilation is deemed necessary.

In the embodiment shown in the drawings, a channel 216 is provided generally centrally between the upper and lower edges with secondary channels being provided just inwardly of the upper marginal end portion and the lower marginal end portion. The number of channels may be varied depending upon the size and width of the hardboard panel.

The features of the present embodiment which include the flattened upper edge of the locking tongue and the flattened incorporated with the locking tongues and locking seats of the embodiments shown in FIGS. 1–3. It has been determined that these features will assist in insuring proper alignment in end-to-end relationship of those panel members as well as the panel members of the present embodiment. In all the embodiments of the present invention, the panels will be interlocked in such a manner that only a single line of nails or other fasteners will be necessary to secure the panels to the support surface and further that such fasteners will be effectively covered during use. This will insure that the painted surface portion of each panel member as is shown generally at 300 in FIG. 9 will be free of any fastening elements or holes which would affect the longevity of the treated painted surface. With this being the case, purchasers will be able to obtain much greater warranties with regard to the surface treatment applied to panel members thereby making the hardboard product more beneficial for the consumer.

I claim:

1. A siding panel for selective attachment to an underlying support surface comprising; a unitary body of hardboard material having a front face, a back face, an upper edge and a lower edge, and upper and lower marginal edge portions extending inwardly from said upper and lower edges respectively, said upper edge of said body being bevelled to provide a V-shaped locking tongue, said bevelled upper edge extending downwardly and rearwardly from adjacent said front face of the panel to said back face to thereby form a line contact which engages the underlying support surface when said body is selectively attached to the support surface, a locking seat in the form of a notch formed in the back face of said body and extendingly upwardly from said lower edge to underlay said lower marginal edge portion, said body having a uniform thickness between said upper and lower marginal edge portions which is in the range of about 0.375 to 0.5 inch, said bevelled upper edge being bevelled with respect to said front face of said body at a first acute angle and said notch being defined by a second acute angle wherein said second acute angle is greater than said first acute angle, said second acute angle being approximately 35° to 40° with said first acute angle being approximately 5° to 10° less than said second acute angle and said notch having a depth measured from said back face which is not greater than that which reduces the thickness of the lower marginal even portion to about 0.1875 inch such that when the locking tongue of one panel is seated in the locking seat of a second panel when adjacent panels are arranged with their marginal edge portions overlapping one another on the support surface, the greater thickness of said upper marginal edge will serve to space a substantial portion of said back face of said second panel from the support surface to create a drying air gap therebetween with the line contact of said one panel being adjacent said lower edge of said second panel.

2. The siding panel of claim 1 in which said notch includes a substantially flat base portion and said upper edge of said body includes a generally flattened surface of a dimension to cooperatively abut said base portion of said notch.

3. A siding panel for selective attachment to an underlying support surface comprising; a unitary body of hardboard material having a front face, a back face, an upper edge and a lower edge, and upper and lower marginal edge portions extending inwardly from said upper and lower edges respectively, said upper edge of said body being bevelled to provide a V-shaped locking tongue, said bevelled upper edge extending downwardly and rearwardly from adjacent said front face of the panel to said back face, said bevelled upper edge extending downwardly and rearwardly with respect to the front face at a first acute angle, a locking seat in the form of a notch formed in he back face of aid body and extending upwardly from said lower edge to underlay said lower marginal edge portion, said notch being defined by a pair of outwardly extending wall portions which extend outwardly with respect to one another at a second acute angle, said second acute angle being larger than said first acute angle, said second acute angle being approximately 35° to 40° with said first acute angle being approximately 5° to 10° less than said second acute angle whereby said V-shaped locking tongue may be selectively received within said notch of a second panel when adjacent panels are arranged with their marginal edge portions in overlapping relationship with respect to one another on an underlying support surface.

4. The siding panel of claim 3 in which and said first acute angle is approximately 5° to 7° less than said second acute angle.

5. The siding panel of claim 3 including a chemical coating applied to said front face of said panel, said back face being somewhat convexly curved from said upper to said lower edge, at least one channel formed in said back face, said channel extending generally parallel with respect to said upper and lower edges, said channel having opposing said walls, said side walls being moveable toward one another as the panel is applied to an underlying support surface to thereby permit said back face to assume a generally planar configuration.

6. The siding panel of claim 3 in which said notch includes a substantially flat base portion and said upper edge of said body includes a generally flattened surface of a dimension to be cooperatively abutted against said base portion of said notch.

7. A siding panel for selective attachment to an underlying support surface comprising, a unitary body of hardboard material having a front face, a back face, an upper edge and a lower edge, and upper and lower marginal edge portions extending inwardly of said upper and lower edges, respectively, said front face including at least one elongated tapered groove therein which extends parallel with said upper and lower edges and is simulative of a joint between overlapping adjacent panels, said upper marginal edge portion tapering inwardly from said outer surface toward said upper edge of said panel, said back face being bevelled adjacent said upper edge to provide a generally V-shaped locking tongue, the bevelled upper marginal edge portion extending downwardly and rearwardly from said upper edge at a first angle and a first distance, a locking seat in the form of an elongated generally V-shaped notch formed in said back face of the panel and extending upwardly from said lower edge so as to underlay said lower marginal edge portion, said notch having a base portion and opening outwardly from said base portion at a second acute angle which is greater than said first acute angle, said second acute angle being approximately 35° to 40° with said first acute angle being approximately 5° to 10° less than said second acute angle, whereby said locking tongue of an adjacent panel may be selectively seated within said locking seat when two panels are brought into assembled relationship, said body having a predominent thickness dimension between said front and back faces, said lower marginal edge portion and said locking tongue having a combined thickness dimension when said locking tongue of one panel is seated within said locking seat of an adjacent panel which is substantially equal to said predominent thickness of the said body so that said back faces of said adjacent panels will be substantially co-planar when secured to the support surface.

8. The siding panel of claim 7 in which said base portion of said notch is generally flattened and said upper edge of said panel is generally flattened.

9. The siding panel of claim 8 in which said flattened base portion of said notch does not exceed approximately 1/32 of an inch.

10. The siding panel of claim 7 in which said second acute angle is generally 5° to 7° larger than said first acute angle of said locking tongue.

11. The siding panel of claim 10 in which said base portion of said notch is generally flattened and said upper edge of said panel is generally flattened.

12. The siding panel of claim 11 in which said flattened base portion of said notch does not exceed approximately 1/32 of an inch.

13. The siding panel of claim 12 in which at least one elongated channel is provided in said rear face of the panel, said channel extending generally parallel to said upper and lower edges, said channel including spaced side walls, said channel being of sufficient depth to permit said side walls to close relative to one another as said panel is secured to the support surface.

14. The siding panel of claim 8 in which at least one elongated channel extending generally parallel to said upper and lower edges, said channel including spaced side walls, said channel being of sufficient depth to permit said side walls to close relative to one another as said panel is secured to the support surface.

15. The siding panel of claim 7 in which at least one elongated channel is provided in said rear face of the panel, said channel extending generally parallel to said upper and lower edges a chemical coating applied to said front face of said panel, said back face being somewhat convexly curved from said upper to said lower edge, said channel having opposing side walls said side walls being moveable toward one another as the panel is applied to an underlying support surface.

16. The siding panel of claim 15 including a plurality of elongated channels provided in said rear face of the panel.

* * * * *